US007210710B2

(12) United States Patent
Williamson et al.

(10) Patent No.: US 7,210,710 B2
(45) Date of Patent: May 1, 2007

(54) DRILL STEM CONNECTION

(75) Inventors: Joseph Stephen Williamson, Houston, TX (US); Scott L. Granger, Houston, TX (US); Roger D. Chancey, Humble, TX (US)

(73) Assignee: Omsco, Inc., Houston, TX (US)

( * ) Notice: Subject to any disclaimer, the term of this patent is extended or adjusted under 35 U.S.C. 154(b) by 292 days.

(21) Appl. No.: 10/790,900

(22) Filed: Mar. 1, 2004

(65) Prior Publication Data

US 2005/0189147 A1 Sep. 1, 2005

(51) Int. Cl.
*F16L 25/00* (2006.01)

(52) U.S. Cl. ..... 285/333; 285/390

(58) Field of Classification Search ..... 285/333, 285/334, 355, 390

See application file for complete search history.

(56) References Cited

U.S. PATENT DOCUMENTS

| | | | | |
|---|---|---|---|---|
| 2,532,632 | A | 12/1950 | MacArthur | |
| 2,885,225 | A * | 5/1959 | Rollins | 285/334 |
| 4,548,431 | A | 10/1985 | Hall et al. | |
| 4,549,754 | A | 10/1985 | Saunders et al. | |
| 4,946,201 | A | 8/1990 | Tai | |
| 5,492,375 | A | 2/1996 | Smith | |
| 5,908,212 | A | 6/1999 | Smith et al. | |
| 6,244,631 | B1 * | 6/2001 | Payne et al. | 285/333 |
| 6,447,025 | B1 * | 9/2002 | Smith | 285/333 |
| 6,478,344 | B2 | 11/2002 | Pallini et al. | |
| 6,511,102 | B2 | 1/2003 | Krug et al. | |
| 6,513,840 | B1 | 2/2003 | Krug et al. | |

FOREIGN PATENT DOCUMENTS

| | | | |
|---|---|---|---|
| CA | 1084553 | A1 | 8/1980 |
| CA | 2408110 | A1 | 4/2003 |
| EP | 1200704 | B1 | 5/2002 |
| WO | WO 2005/095840 | A1 | 10/2005 |

* cited by examiner

*Primary Examiner*—Aaron Dunwoody
(74) *Attorney, Agent, or Firm*—Gary L. Bush, Esq.; Andrews Kurth LLP

(57) ABSTRACT

A double shoulder drill stem connection for high torque applications includes a thread taper within a range between about 1.0 and 1.2 inch per foot. The thread form is characterized by a stab angle between about 35 and 42 and a load angle between about 25 and 34 degrees and by a short thread height with elliptical roots and with crests having an angle which slopes in an opposite direction with respect to the joint centerline from the thread taper. A drill string includes a tool joint having different inner diameters for a substantial axial length to provide enhanced strength in the threaded portion of the joint.

37 Claims, 9 Drawing Sheets

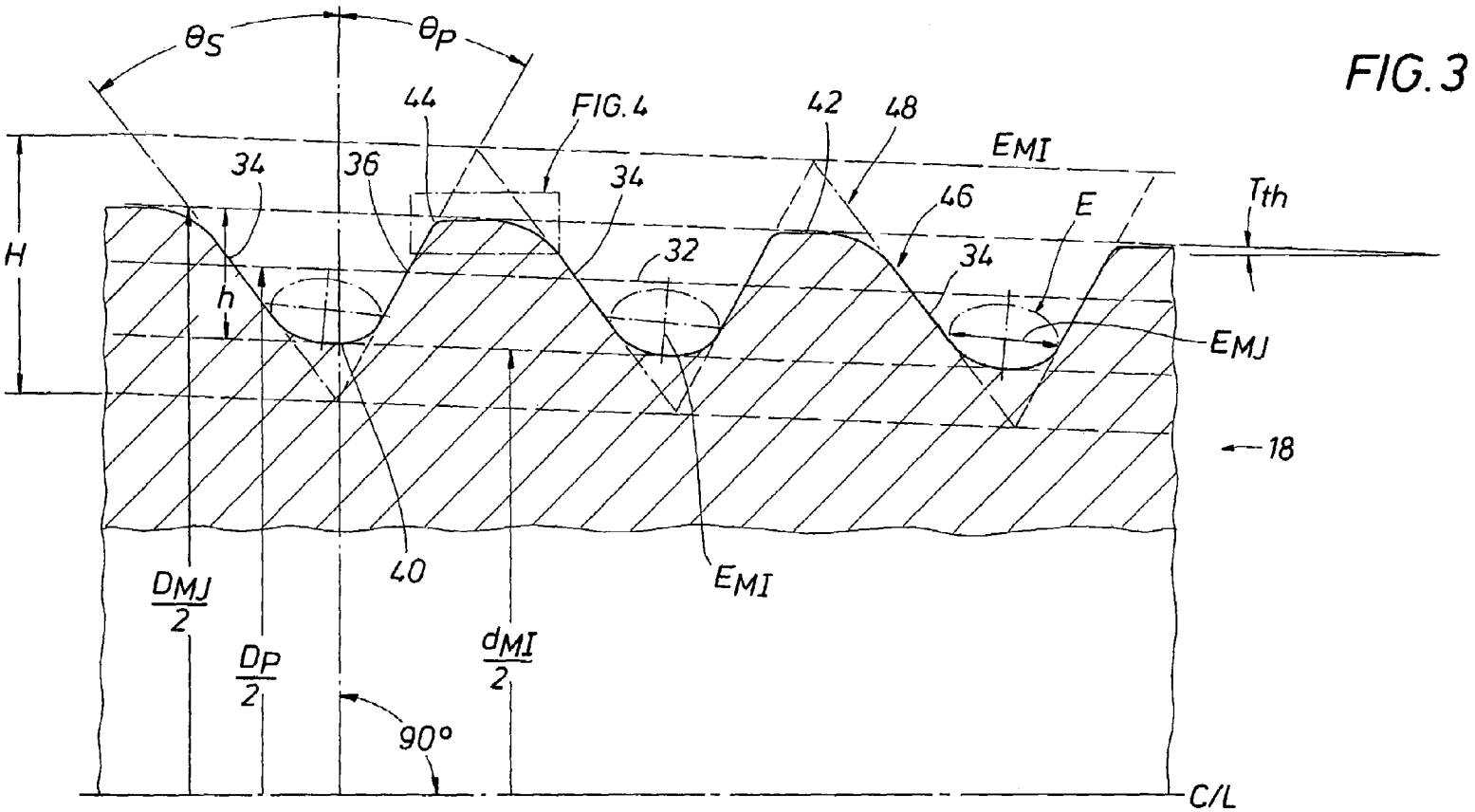
FIG. 3
Tth
18
EMJ
C/L
E
EMI
46
34
48
42
EMI
32
FIG. 4
34
θP
44
36
40
90°
34
h
θS
DMI/2
DP/2
DMJ/2
H
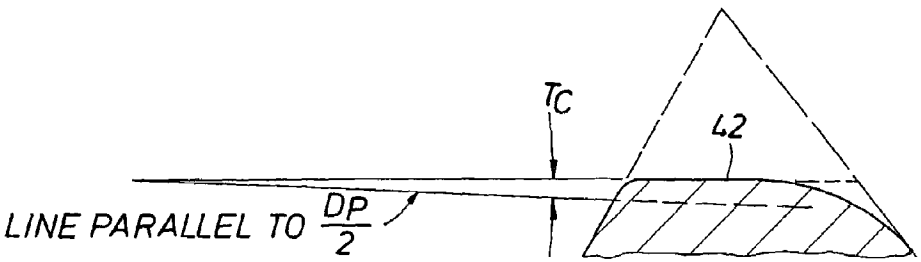
FIG. 4
42
TC
LINE PARALLEL TO DP/2

DRILL STEM CONNECTION

BACKGROUND OF THE INVENTION

1. Field of the Invention

This invention concerns drill stem threaded connections in general. In particular the invention is for a tool joint and a resulting drill string where the tool joint connects drill pipe sections and other elements of the drill stem together from the surface to the drill bit. Still more particularly, this invention is for a tool joint having internal and external make-up shoulders for high torque application of rotary drilling.

2. Description of Prior Art

Deep wells such as for oil and gas are drilled with a rotary drill bit rotated by a drill stem which consists of a bottom-hole assembly, a string of drill pipe, a kelly or top drive, and all associated equipment in the rotating string to the drill bit. The drill pipe string is made-up of individual members, each about 30 feet in length. The drill pipe members are secured together by a threaded connection, called a tool joint, typically about 1½ feet long. The tool joints must withstand the normal torque encountered during drilling, and also provide sealing to prevent drilling fluid being pumped down the drill pipe from leaking out the joints. Leakage out of the tool joints causes wear due to the abrasiveness of the drilling fluid, which can lead to early failure.

A conventional tool joint (sometimes called an API [American Petroleum Institute] tool joint) is made-up of a pin member and a box member. The pin member has external threads and an external annular make-up shoulder. The box member has internal threads and a rim or face that makes up against the make-up shoulder. In a conventional tool joint there is no internal shoulder in the box member for contact by the nose or face on the end of the pin. When the tool joint members are made-up at the surface of the well, normally they are made-up to a torque that creates a longitudinal stress in the threaded cross section that is about one-half the yield strength of the weaker of the pin or box.

In drilling horizontal or extended reach wells or when the drill string gets stuck in the borehole, it is possible for drilling torque to exceed the make-up torque, applied at the surface of the well. When the drilling torque exceeds the surface make-up torque, additional connection make-up torque occurs. The additional make-up torque imparts higher stresses in the connection which may exceed the yield strength of the pin and box and cause downhole failure. To avoid the possibility of failure, the surface make-up torque should be higher than the drilling torque. Consequently the drill pipe tool joint industry has developed so called "double shoulder tool joints" that have higher torque strength characteristics than API tool joints, allowing higher surface make-up torque. Double shoulder tool joints have not only an external make-up shoulder, but also an internal make-up shoulder and dimensions that cause both shoulders to make up under high torque conditions.

As shown in U.S. Pat. No. 2,532,632, double shoulder tool joints have not only an external make-up shoulder, but an internal make-up shoulder and dimensions that cause both shoulders to make-up under high torque conditions. A double shoulder tool joint can have a substantially increased torsional yield strength (as compared to an API tool joint) without any additional thickness in the pin or box, and without increasing the yield strength of the steel.

The prior art has strived to achieve better and better operating characteristics for a double shoulder tool joint by adjusting dimensions of elements that characterize such a joint. Such elements include the relative lengths of the box counterbore, pin base, the pin nose, and the threads; the relative cross sectional thickness of the box counterbore and the pin nose; and the relative dimensions of the tool joint inner and outer diameters.

A double shouldered connection is also described in U.S. Pat. No. 4,558,431. The box is provided with an internal shoulder located below its threads. The pin has a face on the end of its nose that mates with the internal shoulder in the box. The dimensions of the pin and box are selected so that when hand tightened, the box face contacts the external shoulder of the pin. A clearance exists between the pin nose face and the internal shoulder of the box. When the tool joint is fully made-up to its normal make-up torque, the box face engages the external make-up shoulder to the normal contact pressure. A hand tight clearance is selected such that the pin face exerts little or no pressure against the internal shoulder at normal make-up torque.

The above mentioned U.S. Pat. No. 4,548,431 specifies that the pin base and box counterbore sections have a length at least one-third the length of the engaged threads and that the pin nose should have a length at least one-sixth the length of the engaged threads. For the double shouldered tool joint, described in U.S. Pat. No. 4,548,431, with a 5" OD and 2 11/16" ID, the torque to yield the base section of the pin or the counterbore section of the box for a double shouldered joint is 25,583 foot pounds as compared to 18,100 foot pounds for an API tool joint with the same OD and ID. The long counterbore section lowers the resistance to deflection thereby allowing reasonable manufacturing tolerances for the hand tight clearance. However, the long counterbore section tends to buckle outward under high torque.

Others in the industry select the hand tight clearance such that the internal shoulder is substantially loaded at the designed surface make-up torque. Designed in this way, the internal shoulder allows a larger surface make-up torque and may therefore be safely used in wells which require a larger drilling torque. When the tool joint is tightened beyond the initial hand tight condition, the counterbore of the box and the pin base section deflect. This deflection allows the pin face to close the hand tight clearance and engage against the internal shoulder. The loading of the pin face and internal shoulder occurs prior to any permanent deformation occurring in the box counterbore and pin base sections.

Expanding the concept of having the internal shoulder loaded at surface make-up torque, U.S. Pat. No. 6,513,804 describes still another double shouldered tool joint design in which the internal shoulder makes up first, because the length from the pin external shoulder to the pin nose is greater than the length from the box face to the box internal shoulder. The pin nose is specified to be twice as long as the box counterbore. Having the internal shoulder contact before the external shoulder creates a risk that the external shoulder may not be sufficiently loaded to effect a seal. The extra long pin nose attempts to overcome this risk by lowering the nose resistance to deflection.

U.S. Pat. No. 5,492,375 describes another design of a double shoulder tool joint with an emphasis on optimizing the torsional strength of a double shouldered connection. The optimization is achieved by assuring that under high torque conditions, the threads are very close to, but not quite at failure in shear prior to yielding of the pin nose and box counterbore or pin base. U.S. Pat. No. 5,492,375 specifies that the length of the engaged threaded section of the pin, which determines the shear area of the threads be such that $A_t$ is equal to or only slightly greater than $1.73(A_L+A_N)$ where $A_L$ is the lesser of the cross-sectional area of the pin base or of the box counterbore and $A_N$ is the cross-sectional area of the pin nose. Optimization by this technique provides only small increases in connection torsional strength.

U.S. Pat. No. 5,908,212 describes another double shoulder tool joint design by requiring (1) that the sum of the cross-sectional area of the box counterbore, plus the cross-sectional area of the pin nose be at least 70% of the cross-sectional area of the box, (2) that the taper of the threads be less than one inch per foot, and (3) that the counterbore section axial length be at least 1.5 inches.

A shallow thread taper dramatically increases the strength of the internal shoulder and therefore increases the torsional strength of the connection. However, drill pipe joints with shallow thread tapers require substantially more rotations of the pin with the box during make up, as compared to conventional API tool joints. The additional rig time required to make-up these connections is very expensive and undesirable. The shallow taper also makes connection stabbing and unstabbing more difficult, because the connection must be carefully aligned to avoid thread interference and galling. Further, the shallow taper requires a large loss of the limited tool joint length when the connection is re-machined after wear or damage.

The prior art joints also provide conventional thread form designs which inhibit optimum yield torque characteristics for pipe joints generally and in particular for double shoulder drill pipe joints.

The prior art tool joints are also characterized by a thread form with a crest taper that matches the taper of the threads. FIG. 5 of the attached drawings illustrates a prior art thread form where the taper of the crest 41 is the same as the overall taper $T_{th}$ of the threads. A thread form in general is characterized by a thread root 39, a load flank 35, a crest 41, a crest-load radius 43, a crest-stab radius 45 and a stab flank 33. When stabbing elements of the drill pipe joint (i.e., stabbing a pin into a box), it is inevitable that crests of one element will occasionally come to rest on the thread crests of the other. FIGS. 6A, 6B and 6C illustrate a prior art pin 5 and box 5' being stabbed together with FIGS. 6B and 6C showing cross sections of the threads of the pin 5 and box 5'. FIG. 6B shows the crests 41 of the pin 5 resting on the thread crests 41' of the box 5'. As FIG. 6C shows, a rotation of up to about one-half turn is required to move pin 5 axially with respect to box 5' to get past crest 41-crest 41' contact and cause stab flank 33-stab flank 33' contact. If crest to crest contact occurs with an impact, the load flanks 36, 36', stab flanks 33, 33', or both can be permanently damaged near the crests 41, 41', especially because of the small crest to load flank and crest to stab flank radii typically found in conventional tool joints. Even if damage does not occur on stabbing, the pin tool joint crests 41 can wedge into the box tool joint 5'. Such wedging action is exacerbated by the impact. As the thread taper is reduced, the wedging action gets worse. For a friction factor of 0.08, the thread crests 41, 41' are self-holding for thread tapers less than 2"/ft. Self-holding means that the tool joints must be forcibly separated. Forcing the threads past wedging of the thread crests can eventually lead to galling and other damage.

3. Identification of Objects of the Invention

A primary object of the invention is to provide a drill stem connection, in particular for a drill pipe tool joint with enhanced yield torque characteristics.

Another object of the invention is to provide a drill pipe tool joint with enhanced yield torque characteristics while simultaneously having a make-up turns characteristic of a conventional API tool joint.

A specific objective of the invention is to provide a drill pipe tool joint that is characterized by a torsional strength that is at least about fifty percent or more than that of a conventional connection of comparable size and with make-up turns about the same as the conventional connection.

Another object of the invention is to provide a double shoulder drill pipe tool joint with an improved thread form in combination with an optimum thread taper such that enhanced torque characteristics result.

Another objective of the invention is to provide a tool joint with a thread design that provides enhanced stabbing characteristics when the pin is stabbed in the box during make up.

Another object of the invention is to provide a tool joint design with a box counterbore length shorter than or equal to the pin nose length in order to avoid box buckling.

Another object of the invention is to provide a tool joint design characterized by primary shoulder and secondary shoulder stresses being within a range of 70% of each other for optimization of load carrying ability within manufacturing tolerances.

Another object of the invention is to provide a thread form for tool joints where crest-to-crest wedging of threads while stabbing is substantially prevented.

Another object of the invention is to provide a thread form for tool joints that allows the pin threads to more easily center within the box threads while providing a more rugged shape with a more narrow crest without reducing the contact area of the load flank.

Another object of the invention is to provide a thread form which (1) provides a reduced stress concentration in the thread root while maximizing the contact area of the load flank and minimizing thread depth, (2) allows for larger critical areas at the primary and secondary shoulders of a double shoulder tool joint thereby providing increased torque capacity of the joint, and (3) reduces the probability of jamming the connection.

Another specific objective of the invention is to provide a double shoulder drill pipe tool joint characterized by pin nose and counterbore lengths such that stresses at the primary and secondary shoulders increase at a similar rate as connection torque increases are applied to the connection.

Another object of the invention is to provide a tool joint with an enhanced wall thickness opposite the threads in order to provide greater connection strength.

SUMMARY OF THE INVENTION

The objects described above along with other features and advantages of the invention are incorporated in a double shoulder connection joint having a pin nose cross section area which is at least fifty percent as large as the smaller of the cross section area of the box counterbore or the pin base and having threads which are tapered within a range of between about 1.0 and 1.2 inch per foot, preferably about 1.125 inch per foot. A preferred taper is a compromise between a lower limit of 1.0 inch per foot below which the turns from stabbed to snugged generally exceed that required for API tool joints. The upper limit of 1.2 inch per foot is a limit beyond which yield torque for the tool joint decreases significantly below about a one hundred fifty percent torsional of the yield strength of a conventional API connection of comparable size. The preferred taper is about 1⅛ inch per foot. With the pin nose cross section size as specified above, the length of the pin nose is provided to be about 1.0 to 1.5 times the counterbore length in order to achieve primary and secondary shoulder stresses increasing at a similar rate as torque increases are applied to the connection.

The thread form of the internal and external threads of the double shouldered pipe joint is characterized by a thread depth h measured between a major radius $$\frac{D_{MJ}}{2}$$

and a minor radius $$\frac{d_{MJ}}{2}$$

that is about one-half of the height (H) of a fundamental triangle of the threads.

The internal and external threads are also characterized by a stab flank angle between about 35 and about 42 degrees and a load flank angle between about 25 and 34 degrees. The preferred stab flank angle is about 40 degrees, and the preferred load flank angle is about 30 degrees. The stab flank angle of 40 degrees enables the connection to more easily center itself after stabbing (as compared to a conventional 30 degree stab flank angle), as well as providing a more rugged shape and more narrow crest without reducing the contact area of the load flank. The crest-stab radius of the preferred drill pipe arrangement is enlarged beyond that of a conventional thread form.

The threads are also characterized by the roots of the threads being formed in a shape of a portion of an ellipse. Furthermore, the crests have a crest taper which slopes at an opposite angle from that of the thread taper angle. The crest taper sloping at an angle opposite that of the thread taper angle makes crest-to-crest wedging unlikely when the pin and box threads are stabbed together.

The structure of the thread form produces the advantages of the objects identified above, because it (1) provides a reduced stress concentration in the thread root while maintaining maximum contact area of the load flank and minimum thread depth, (2) allows for larger critical areas at the primary and secondary shoulders of a double shoulder tool joint thereby providing increased torque capacity of the joint, and (3) reduces the probability of jamming the connection.

The thread form is characterized by a thread pitch of about 0.25 inch or greater. The preferred thread pitch is about 0.286 inch. The preferred drill pipe joint is also characterized by the length of the pin nose section being about 1.25 inches with the length of the counterbore section being about 1 inch. The cross-sectional area of the counterbore section of the box, the cross-sectional area of the pin section at the pin nose, the cross-sectional area of the pin section opposite the box counterbore, and the length of the connected threads are selected such that the strength of the connected threads when torque is applied is substantially greater than the strength in the pin nose or the box counterbore or the cross-section of the pin opposite the box counterbore.

The tool joint of the invention is also characterized by having an inner diameter which varies as a function of tool joint length so that the tool joint wall is thicker opposite the threads than at its ends in order to provide greater strength to the connection at the threads.

BRIEF DESCRIPTION OF THE DRAWINGS

The drawings attached hereto illustrate a preferred embodiment of the invention of which.

FIG. 3 is an enlarged cross-section of a thread form of the pin threads and the box threads, showing stab and load flanks, root and crest forms and taper according to the invention;

FIG. 4 is an enlarged cross-section of a crest section of the thread form showing that the crest of the threads is tapered at an angle opposite the taper of the threads;

DESCRIPTION OF PREFERRED EMBODIMENTS OF THE INVENTION

The description below describes the preferred embodiments by reference to the attached figures which include reference numbers to parts of the tool string and tool joint of the invention. Correspondence between reference numbers and parts follows:

| Reference Number | Description |
|---|---|
| $P_{OD}$ | Pipe Outer Diameter |
| $P_{ID}$ | Pipe Inner Diameter |
| C/L | Center line of joined pipe and tool joint |
| $PU_{ID}$ | Pipe Upset Inner Diameter |
| $TJ_{ID1}$ | Tool Joint Inner Diameter at weld end of joint |
| $TJ_{ID2}$ | Tool Joint Inner Diameter at a middle portion of joint |
| $TJ_{OD}$ | Tool Joint Outer Diameter |
| $L_{TJ}$ | Tool Joint Length |
| 2 | Lower Drill Pipe |
| 2' | Upper Drill Pipe |
| 3 | Upset portion of lower drill pipe |
| 3' | Upset portion of upper drill pipe |
| 4 | Tool Joint |
| 6 | Lower Weld |
| 6' | Upper Weld |
| 10 | Pin |
| 12 | Box |
| 14 | Box counterbore |
| 16 | Pin Base |
| 18 | External Tapered Pin Threads |

-continued

| Reference Number | Description |
|---|---|
| 20 | Internal Tapered Box Threads |
| 22 | Pin Nose |
| 24 | Box Internal Shoulder |
| 26 | Pin Face or Circular Rim |
| 28 | Box External Shoulder or Box Face or Circular Rim |
| 30 | Pin External Shoulder |
| 32 | Pitch Line of Threads |
| 34 | Stab Flank of Threads |
| 36 | Pressure or Load Flank of Threads |
| $\Theta_S$ | Stab Angle |
| $\Theta_P$ | Pressure or Load Angle |
| $L_{PN}$ | Pin Nose Length |
| $L_{BC}$ | Box Counterbore Length |
| $L_{TH}$ | Length of Engaged Threads |
| PS | Primary Shoulder and Seal |
| SS | Secondary Shoulder |
| $CS_{BC}$ | Cross Section of Box Counterbore |
| $CB_{PB}$ | Cross Section of Pin Base |
| $CS_{PN}$ | Cross Section of Pin Nose |
| 40 | Thread Root |
| 42 | Thread Crest |
| 44 | Transition Shape from Load Flank to Crest |
| 46 | Transition Shape from Crest to Stab Flank |
| 48 | Fundamental Triangle of Thread Shape |
| H | Height of Fundamental Triangle |
| h | Thread Depth |
| $\frac{D_{MJ}}{2}$ | Major Radius (1/2) |
| $\frac{D_P}{2}$ | Pitch Radius (1/2) |
| $\frac{d_{MI}}{2}$ | Minor Radius (1/2) |
| E | Ellipse for Root Form |
| $E_{MI}$ | Ellipse Minor Diameter |
| $E_{MJ}$ | Ellipse Major Diameter |
| $T_{th}$ | Thread Taper |
| $T_C$ | Crest Taper |

Description of Drill Pipe with Tool Joints

Figure 1:
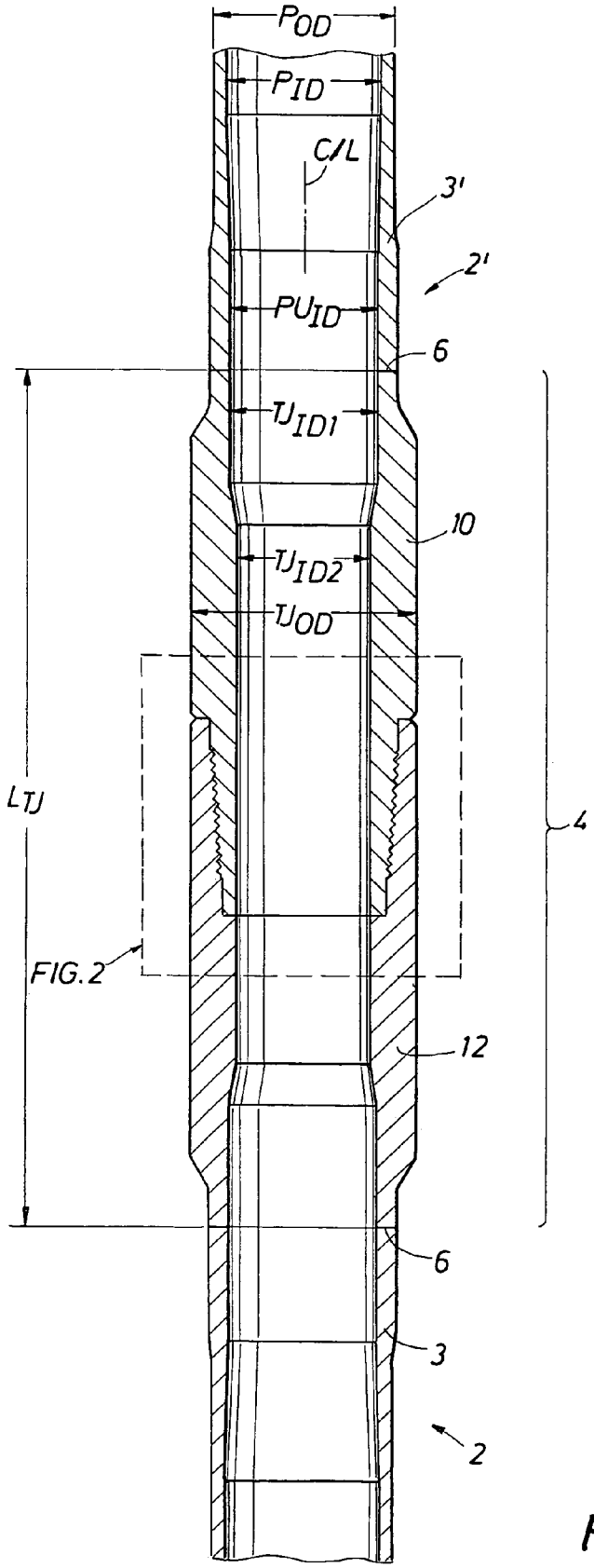
FIG. 1 is a cross-section of the two drill pipe sections joined end to end by a tool joint according to the invention.

FIG. 1 illustrates lower and upper drill pipes 2, 2' connected together by means of a tool joint 4 according to the invention. The drill pipes 2, 2' have upset portions 3, 3' which have thicker wall thickness for welds 6, 6' at the ends of the drill pipe to the ends of the tool joint 4. The Outer Diameter of the pipes 3, 3' is indicated as $P_{OD}$ while the pipe inner diameter, for almost all of its 30' length, is indicated as $P_{ID}$. The inner diameter of the ends of the pipe 3, 3' at the upset portion is indicated as $PU_{ID}$ which approximately matches the inner diameter $TJ_{ID1}$ of the weld ends of the Tool Joint. While the outer diameter of the tool joint $TJ_{OD}$ is substantially constant along the length of the tool joint $L_{TJ}$, the inner diameter of the tool joint narrows from $TJ_{ID1}$, at the weld ends of the joint to $TJ_{ID2}$ for the section adjacent the threads of the pin 10 and box 12. According to the invention, $TJ_{ID2}$ may be ⅛ inch (or more) smaller in diameter than $TJ_{ID1}$, in order to provide thicker wall thickness for the threaded section of the tool joint 4. It has been found that while too small an inside diameter for the tool joint may decrease allowable fluid flow rates during drilling operations, a small decrease of ⅛ inch or ¼ inch inside diameter over a short length can be tolerated while providing significant enhancement to the torque strength of the joint. It is preferred that the length of the tool joint where $TJ_{ID2}$ applies be not greater than about ⅔ of the total tool joint length LTJ.

Figure 2:
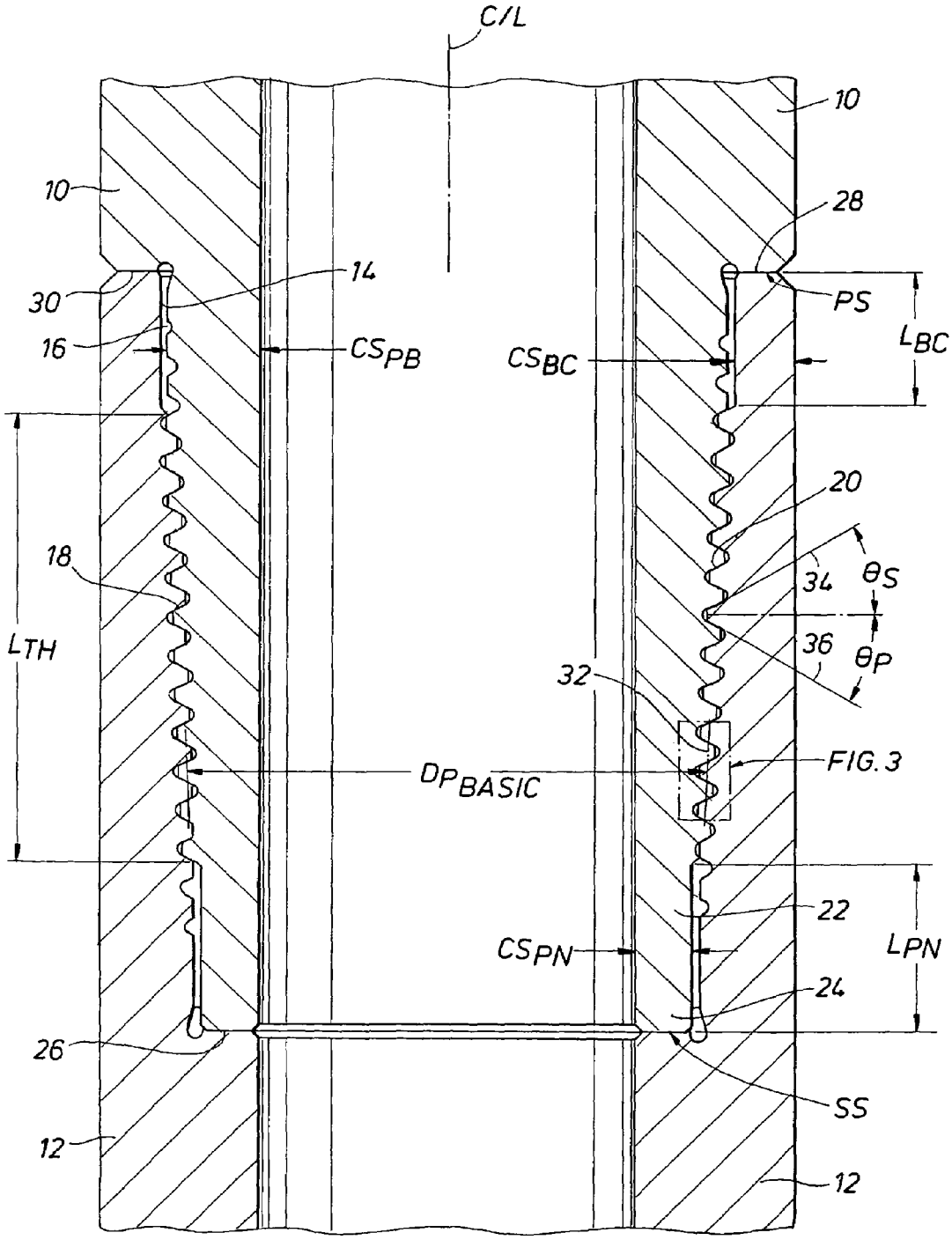
FIG. 2 is an enlarged cross-section illustration of the tool joint showing pin and box members made-up and showing tapered threads and a thread form according to the invention.
Figure 5:
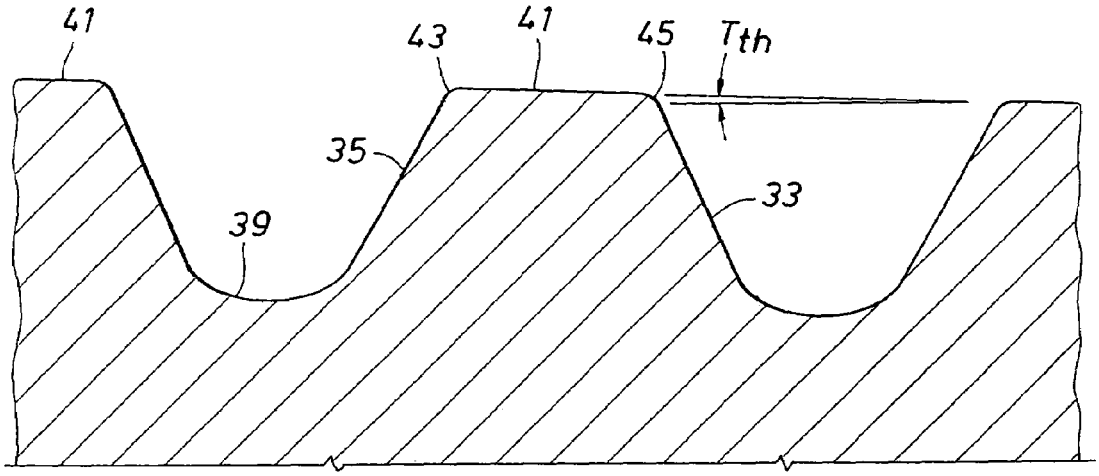
FIG. 5 (PRIOR ART)
FIG. 5 illustrates a prior art thread form with a conventional crest arrangement which tapers at the same angle as that of the threads.
Figure 6A:
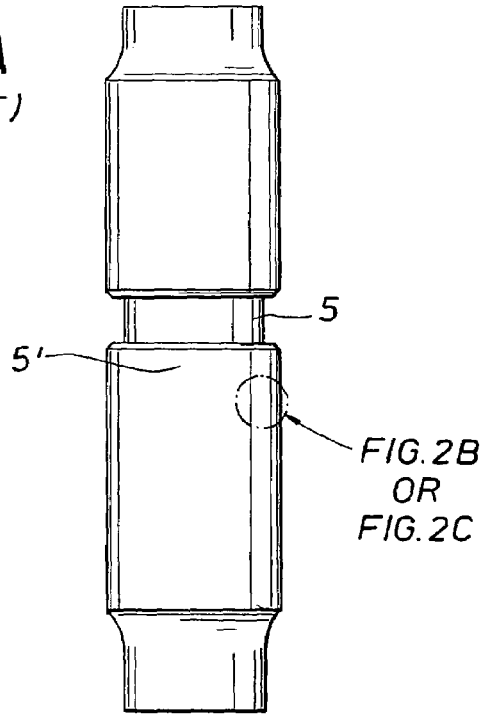
FIG. 6A (PRIOR ART)
FIGS. 6A, 6B and 6C illustrate possible crest wedging of prior art stabbed tool joints where conventional crest taper angles match that of the threads.
Figure 6C:
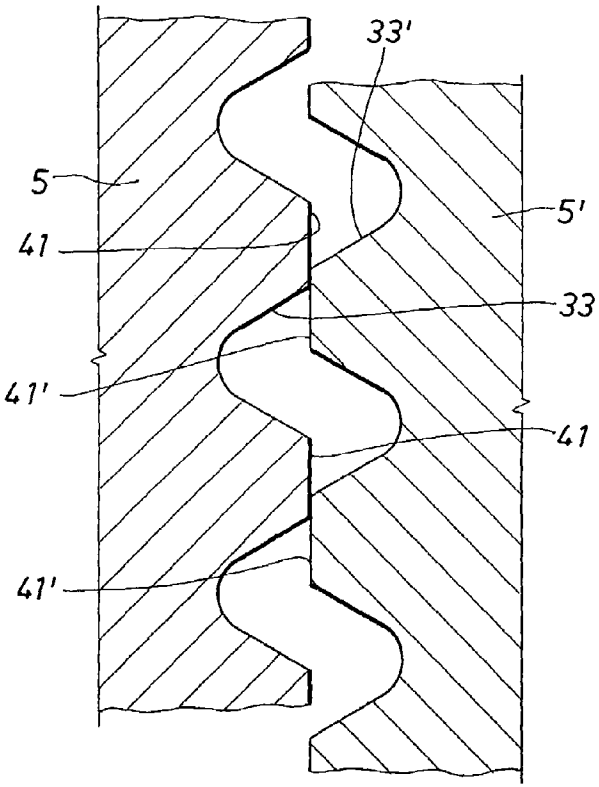
FIG.6C (PRIOR ART)
Figure 6B:
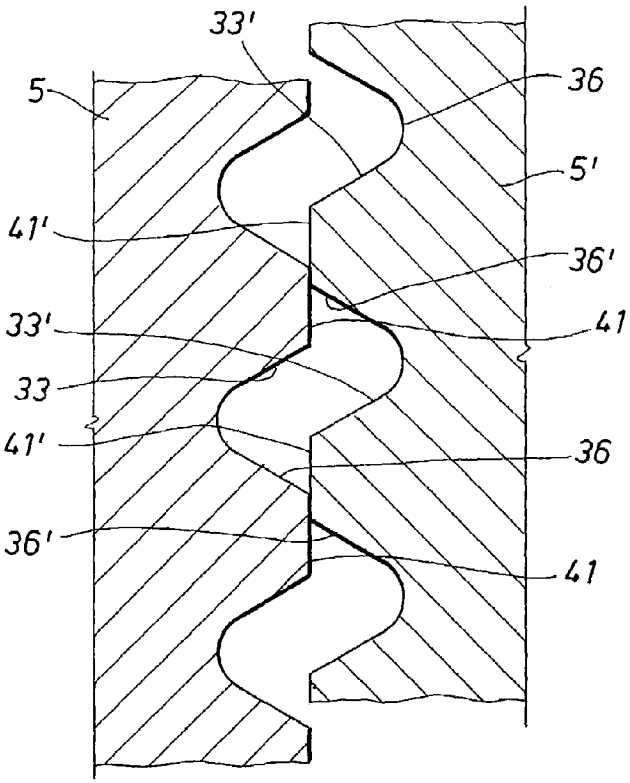
FIG.6B (PRIOR ART)

FIG. 2 illustrates the double shoulder tool joint fully made up. According to a preferred embodiment of the invention, the pin nose cross sectional area $CS_{PN}$ is at least fifty percent as large as the smaller of the cross sectional area of the box counterbore $CS_{BC}$ or cross sectional area of the pin base $CS_{PB}$. Such a relationship in pin nose, pin base, and counterbore cross section areas results in at least fifty percent increase in torsional strength of the connection 4 as compared to a conventional API connection of comparable size. Further, as explained below, the thread taper of the box threads 20 and the pin threads 18 should be within a range between about 1 inch/foot and 1.2 inch/foot, and preferably about 1⅛" per foot. Furthermore, with the pin base cross section $CS_{PN}$ being about fifty percent smaller than the box counterbore cross section $CS_{BC}$, the length of the pin nose $L_{PN}$ should be about one to one and one-half times as long as the counterbore length $L_{BC}$ in order that the stresses at the primary PS and secondary SS shoulders increase at about the same rate as torque is applied to the connection.

It is essential that when excessive torque is applied to the tool joint, that the threads 18 and 20 do not fail in shear before the box counterbore 14 or the pin nose 22 yield or buckle or before yielding of the cross-section of the pin base 16 opposite the box counterbore. Accordingly, the pin nose cross-sectional area $CS_{PN}$ and the length $L_{TH}$ of the internal threads 20 connected to the external threads 18 and the cross-section of the box counterbore $CS_{BC}$ and the counterbore length $L_{PN}$ are designed and arranged as specified above such that the strength of the connected threads is greater than the torque strength of the pin nose 22 or the box counterbore 14. Since thread failure is worse than pin or box yield, a safety factor in the thread strength is provided for the preferred embodiment of the invention even if exact optimization of the connection torsional strength does not result. The preferred safety factor in thread strength is provided with the pin nose cross-section $CS_{PN}$ being least 50% as large as the cross-section of the box counterbore $CS_{BC}$.

Figure 9:
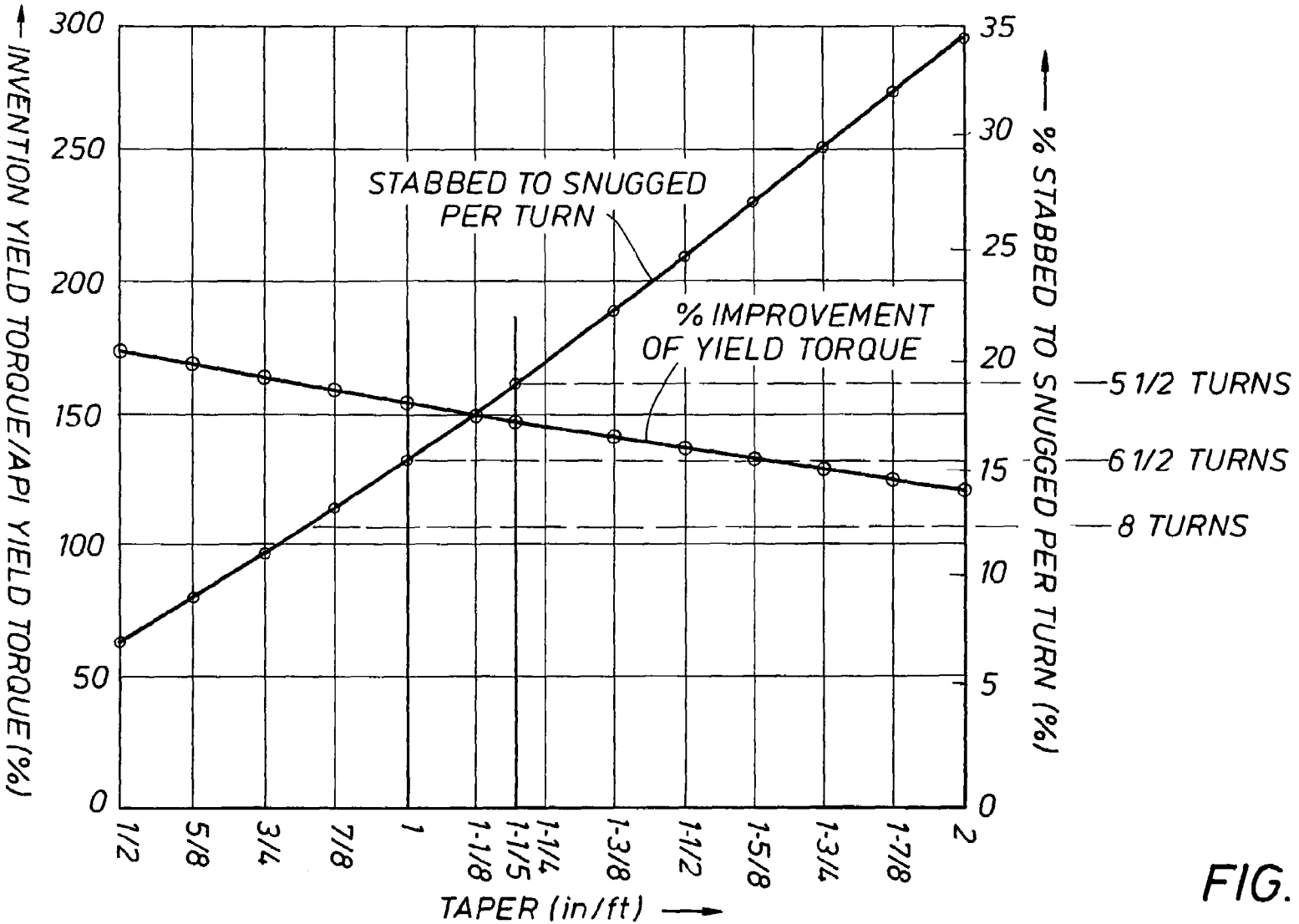
FIG. 9 is a graph showing a range of acceptable tapers for a preferred embodiment of the double shoulder tool joint of the invention showing that too large a taper decreases yield torque of the connection, but too small a taper requires excessive turns from stabbed to snugged of the connection.

FIG. 9 illustrates a parametric study for a preferred embodiment of the invention (i.e., with $CS_{PN} \geqq 0.5\ CS_{BC}$, $CS_{PN} \geqq 0.5\ CS_{PB}$, and $L_{PN} \cong (1.0 \text{ to } 1.5) L_{BC}$), a thread pitch of 0.286 inch (3.5 threads/inch), a thread depth of about 0.1 inch and a pitch diameter of about 3.8 inch showing two parameters which characterize the tool joint of the invention plotted as a function of thread taper in inch/foot. The left ordinate or y-axis represents the ratio of yield torque of the connection of FIGS. 2 and 3 to yield torque of an API connection (e.g., NC 38). The curve labeled "Invention Yield Torque/API Yield Torque (%)" shows that the connection of FIGS. 2 and 3 produces increased yield torque, as compared to API connections, with decreases in thread taper from 2 in/ft to ½ in/ft. The ratio of yield torque is about 150% at a thread taper of 1⅛ in/ft.

The right ordinate represents a parameter that indicates how many turns it takes for the connection to reach a snugged condition after initial stabbing. The curve, labeled "stabbed to snugged per turn," shows that for the connection with ½ in/ft taper, one turn produces only about 7% of the axial travel necessary from the threads to reach snugged. On the other hand, for a 2 in/ft taper, one turn produces close to 35% of the axial travel of the threads to reach snugged. The stabbed to snugged curve indicates that for a taper of 1⅛ in/ft, the stabbed to snugged per turn is about 17%. In other words, it takes about 6 turns to achieve snugging from initial stabbing for the connection with a taper of 1⅛ in/ft.

A range of tapers has been discovered for the preferred embodiment of the tool joint described above that produces acceptable speed when making up the connection while maintaining an increased torsional strength of about 150% of a conventional API connection. As FIG. 9 illustrates, a lower limit of taper of about 1 in/ft and an upper limit of taper of about 1.20 in/ft produces acceptable limits of turns from stabbed to snugged of about 6½ turns and 5½ turns. Such a range is acceptable while not sacrificing significant reductions from a maximized yield torque of about 150% as compared to an API connection. A thread taper of about 1⅛ is preferred to maintain a high yield torque (e.g., 150% of an API connection) of the connection while simultaneously maintaining the number of turns (about 6 turns) to achieve snugged from initial stabbing as quickly as possible.

As indicated above, the taper range of 1 in/ft to 1⅕ in/ft results in a range of between 6½ turn to 5½ turn for the specified preferred embodiment with a pitch of 0.286 inch (3.5 threads/inch). If the parameter of the thread form is relaxed, for example if the pitch is 0.25 inch (4 threads/inch), then the taper of 1 in/ft results in about 8 turns required from stab to snug, a value about the same as for a conventional API connection.

Within the taper range between 1 and 1⅕ (1.2) in/ft., the other thread form variables (pitch, pitch diameter, major diameter, and minor diameter) which affect yield torque and turns to snug may be adjusted from the embodiment specified above. For example, if pitch is reduced from 0.286 inch (3½ threads/inch) to 0.25 inch (4 threads/inch) with the other variables constant, the turns required from stab to snug for a taper of 1 in/ft. would be less than 8 turns.

FIG. 2 illustrates a preferred embodiment of the double shoulder tool joint of the invention fully made up. According to the embodiment, the thread taper of the box threads 20 and the pin threads 18 should be within a range between about 1 inch/foot and 1.2 inch/foot, and preferably about 1⅛" per foot.

Description of Preferred Thread Form of a Drill Pipe Tool Joint

FIGS. 2 and 3 illustrate the thread form of the box threads 20 and pin threads 18 of the connection of FIG. 1. It is preferred that the thread form have less than or equal to 4 threads/inch, a common value for API threads. Furthermore as illustrated particularly in FIG. 3, threads should have a thread depth h as measured between a major radius $$\frac{D_{MJ}}{2}$$

and a minor radius $$\frac{d_{MJ}}{2}$$

that is about one-half of the height of a fundamental triangle 48 that defines the threads. The arrangement allows for larger critical areas of the primary and secondary shoulders and ultimately produces a further increase in torque capacity of the joint. Furthermore, the internal threads 20 and external threads 18 should have a stab flank 34 that makes an angle $\Theta_S$ with the fundamental triangle 48 from about 35 to about 42 degrees and a load flank angle $\Theta_P$ between about 25 and about 34 degrees. Preferably the stab flank angle $\Theta_S$ is about 40 degrees and the load flank angle $\Theta_P$ is about 30 degrees.

The thread form of FIG. 3 is also characterized by crests 42 with a transition shape 44 between a load flank 36 and a crest 42. The transition shape 44 is characterized as a radius that is less than or equal to 0.012 inch thereby providing a large load flank 36. A transition shape 46 between the stab flank 34 and the crest 42 is equal to or greater than about 0.073 inch radius thereby reducing the thread crest width and enabling a gradual entry of the mating thread during stab-in and make up. The roots 40 of the thread form according to the invention are formed in the shape of an ellipse E having a major axis of $E_{MJ}$ and a minor axis $E_{MI}$. The root shape 40 is selected to provide a smooth transition with the stab flank 34 and pressure flank 36. The ellipse shape E produces a stress concentration factor less than that of a 0.038 inch root radius.

Figure 7C:
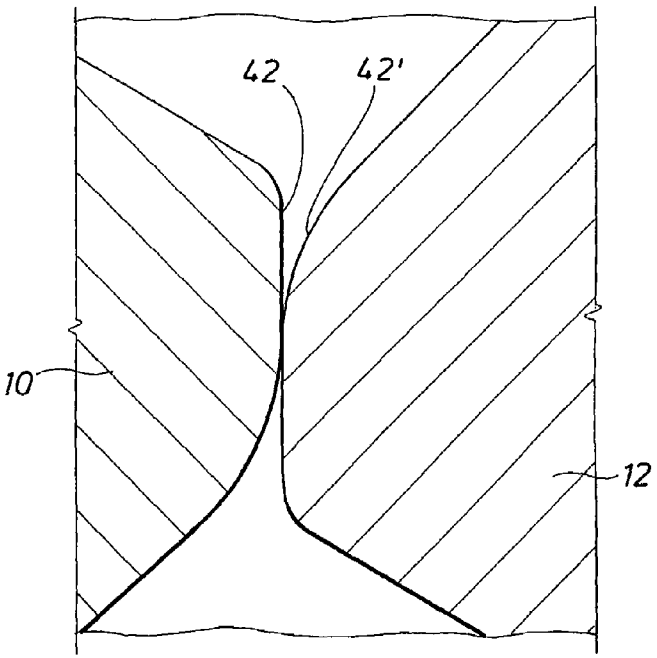
FIGS. 7A, 7B, 7C illustrate stabbing of pin and box threads of a tool join with a thread form having a thread crest as in FIG. 6 which slopes opposite to the thread taper.
Figure 7B:
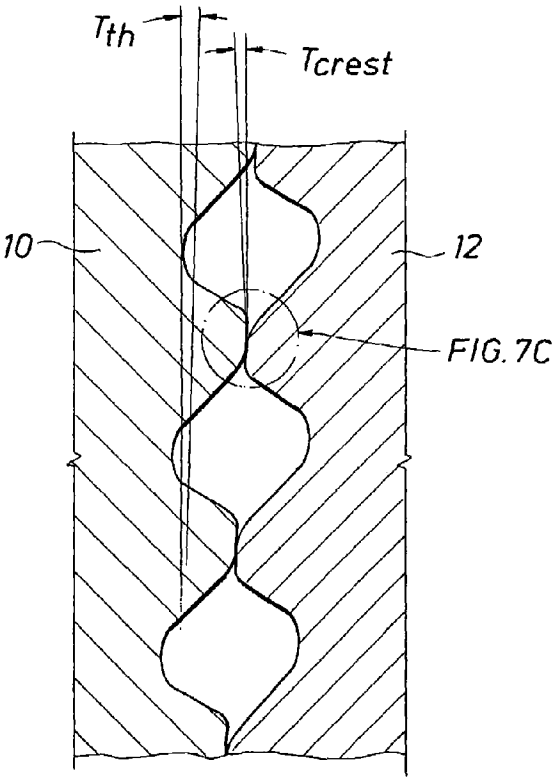
Figure 7A:
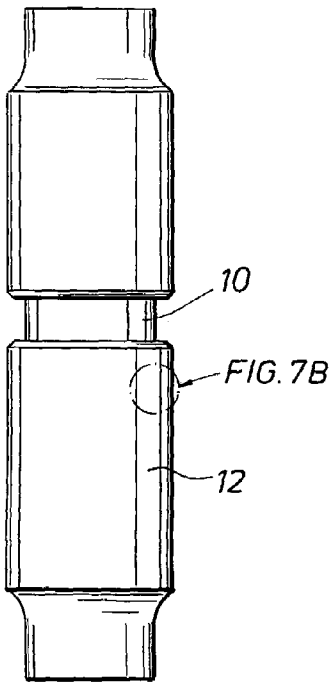

As can be seen in the enlargement of the thread crest 42 in FIG. 4, the top of the crest 42 slopes with a crest taper $T_C$ at an angle opposite from that of the thread taper $T_{th}$. Preferably crest taper is about 1 degree. The description above of prior art thread forms by reference to FIGS. 5 and 6A, 6B and 6C shows that a crest 41 crest taper that is angled approximately the same as the thread taper $T_{th}$ can produce wedging of the threads. Conventional parts of the thread forms are labeled: thread root 39, stab flank 33, load flank 35, transition from load flank to crest 43, and transition from crest to stab flank 45. A thread form with a crest taper $T_C$ at an angle opposite from that of the thread taper $T_{th}$ allows the pin to be more easily stabbed into the box. FIGS. 7A, 7B and 7C illustrates the advantage, where FIG. 7A is a side view of a pin 10 being stabbed into a box 12 of the tool joint and FIGS. 7B and 7C showing the effect of the reverse angle $T_C$ of the crests of the threads. As seen in the enlarged view of FIG. 7C, crest-to-crest wedging of crests 42, 42' is unlikely during stabbing due to the crest slopes being in an opposite direction from the thread taper. FIGS. 7A to 7C illustrate this advantage by reference to conventional prior art thread forms shown in a stabbing relationship of FIGS. 6A to 6C.

Figure 8A:
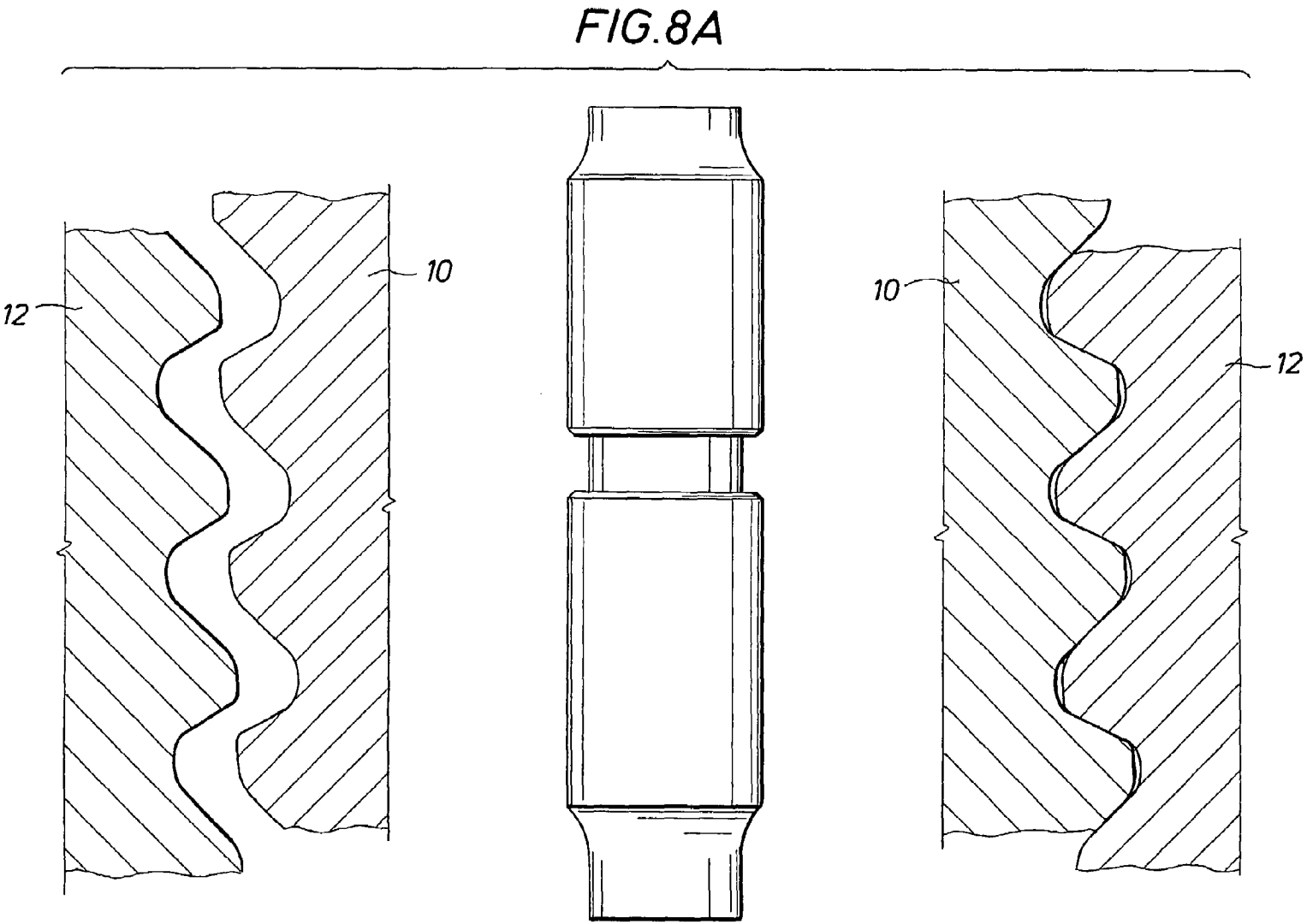
FIGS. 8A and 8B illustrate that an increased stab flank angle and large crest-stab radius of the thread form of FIG. 5 allows the pin threads to center into the box threads easier than with conventional thread forms.
Figure 8B:
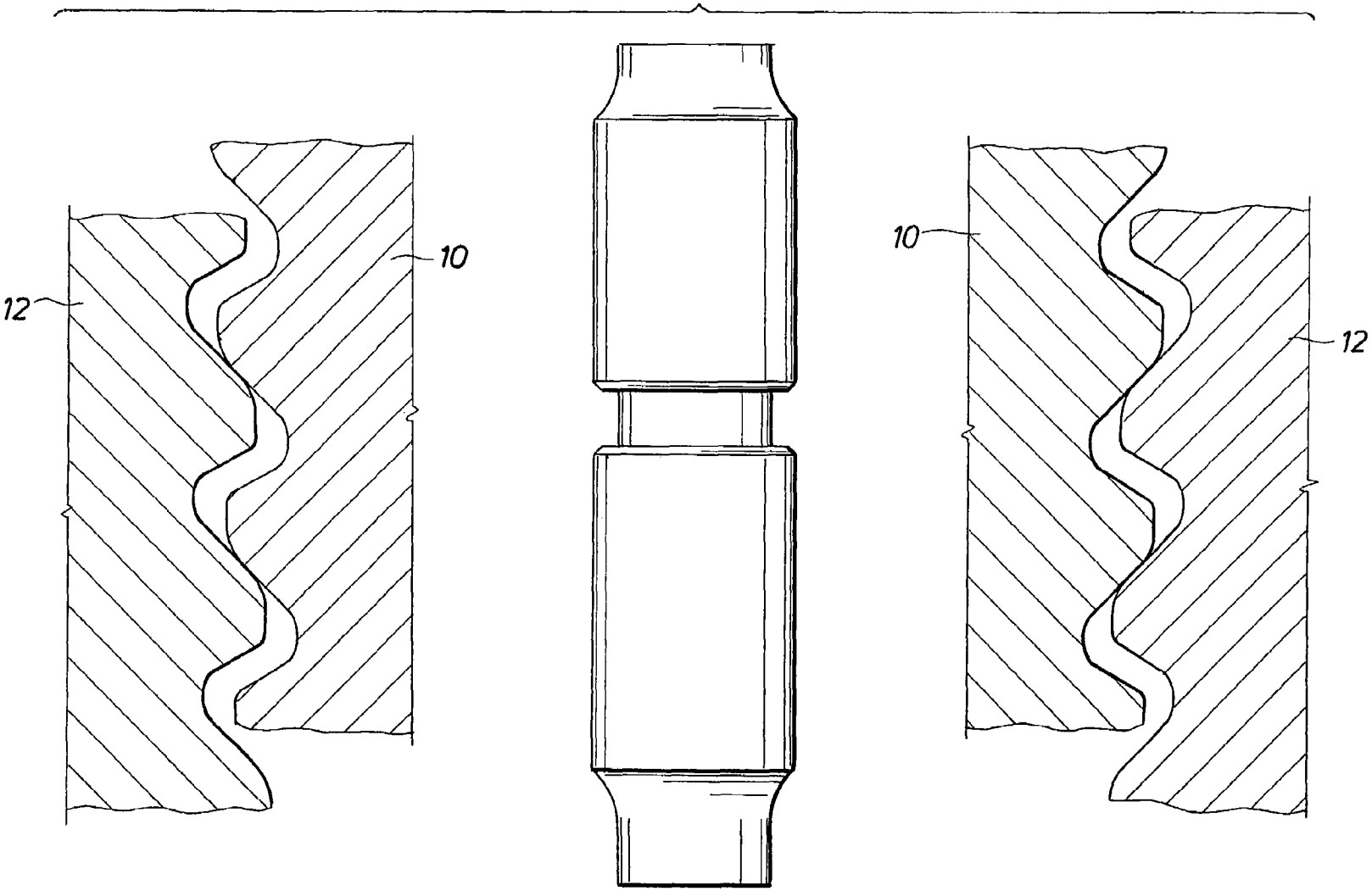

As indicated above, the stab flank angle $\Theta_S$ is increased from a conventional 30° to a preferred 40°. Also mentioned above it that according to the invention, the crest-stab flank transition shape 42 is increased to a 0.073 inch or greater radius. A larger $\Theta_S$ and the large crest-stab flank transition shape allows the connection to more easily center itself after stabbing. FIGS. 8A and 8B illustrate the effect. The pins in FIG. 8A illustrate being stabbed into the box 12 from at an angle from the center line of the box 12. Because of the increased stab angle $\Theta_S$ and the larger crest-stab flank transition shape, the pin 10 moves into alignment with the center line of the box 12 more easily. Furthermore, the probability of jamming of the connection is reduced, because there is less material to get in the way.

What is claimed is:

1. A double shoulder connection joint (4) for use in a drill stem, having a pin (10) with external threads (18) formed between a pin external shoulder (30) and a pin face (26), a box (12) with internal threads (20) formed between a box external shoulder (28) and a box internal shoulder (24), the box (12) having a counterbore section (14) between the internal threads (20) and the box external shoulder (28), the pin having a base section (16) between the external shoulder (30) and the external threads (18), and a nose section (22) between the external pin face (26) and the external threads (18), said internal threads (20) and said external threads (18) are arranged and designed for connection with each other so that said box (12) and said pin (10) are connected with a common center-line (C/L) and with a primary seal (PS) formed by said pin external shoulder (30) forced against said box external shoulder (28) and a secondary shoulder (SS) formed by said pin face (26) forced against said box internal shoulder (24), and wherein said connection joint is characterized by, said internal threads (20) and said external threads (18) having a thread taper ($T_{th}$) (C/L) which is greater than a thread taper ($T_{th\ lower}$) of 1.0 inch per foot, and which is less than an upper limit ($T_{th\ upper}$) of 1.2 inch per foot.

2. The connection of claim 1, wherein thread form characteristics of pitch, thread major diameter, and thread pitch diameter are arranged and designed so that less than 8 turns are required from stabbed to snugged.

3. The connection of claim 2, wherein said turns required from stabbed to snugged is about 6 turns with a thread taper of about 1.125 inch per foot.

4. The connection of claim 1, wherein said external and internal threads are characterized by a thread depth (h), measured between a major radius $$\left(\frac{D_{MJ}}{2}\right)$$

and a minor radius $$\left(\frac{d_{MI}}{2}\right),$$

is about one-half or less of the height (H) of a fundamental triangle of the threads.

5. The connection of claim 1, wherein said internal threads (20) and said external threads (18) are characterized by a stab flank angle ($\Theta_S$) between about 35 and about 42 degrees and a load flank angle ($\Theta_P$) between about 25 and about 34 degrees.

6. The connection of claim 5, wherein said stab flank angle ($\Theta_S$) is about 40 degrees and said load flank angle ($\Theta_P$) is about 30 degrees.

7. The connection of claim 1, wherein roots of said internal threads (20) and said external threads (18) are formed in a shape of a portion of an ellipse (E).

8. The connection of claim 1, wherein said internal threads (20) and said external threads (18) are characterized by crests having a crest taper ($T_C$) which slopes at an opposite direction from that of said thread taper ($T_{th}$).

9. The connection of claim 5, wherein said internal threads (20) and said external threads (18) are characterized by crests, and a transition shape (44) between said load flank (36) and said crest (42) includes a radius of curvature equal to or less than 0.012 inch, thereby providing a large load flank.

10. The connection joint of claim 5, wherein said internal threads (20) and said external threads (18) are characterized by thread crest widths formed by the truncation of the threads of a total height (H), and a transition shape (46) between said stab flank (34) of said crest (42) includes a radius of curvature greater than 80% of the said thread crest width, thereby enabling a gradual entry of the mating thread during stab-in and make up.

11. The connection of claim 7, wherein roots of said internal threads (20) and said external threads (18) are characterized by an elliptical shape that produces a stress concentration factor less than that of a 0.038" root radius.

12. The connection of claim 1, wherein said internal threads (20) and said external threads (18) are characterized by a thread form with a pitch of about 0.25 inches or greater.

13. The connection of claim 1, wherein said nose section (22) of said pin (10) has a length ($L_{PN}$) equal to or greater than a length ($L_{BC}$) of said counterbore section (14).

14. The connection of claim 13, wherein said length ($L_{PN}$) of said pin nose section (22) is about 1.25 inches and said length ($L_{BC}$) of said counterbore section (14) is about 1 inch.

15. The connection of claim 1, having a pin nose cross section area, a counterbore cross-section area and a length $L_{TH}$ of said internal threads (20) connected with said external threads (18) that are designed and arranged such that torque applied to the assembled connection causes substantial yielding to first occur in the weaker of the pin base section or the box counterbore section or of the pin nose.

16. The connection of claim 1, wherein when said pin (10) and said box (12) are connected together, said box external shoulder (28) and said pin external shoulder (30) define a Primary Shoulder (PS) and said pin face (26) and said box internal shoulder (24) define a Secondary Shoulder (SS), and said pin nose length ($L_{PN}$), said counterbore length ($L_{BC}$), a length ($L_{TH}$) of said internal threads (20) connected with said external threads (18), pin nose cross-sectional area ($CS_{PN}$), box counterbore area ($CS_{BC}$), pin base section area and tool joint outer and inner diameters ($TJ_{OD}$, $TJ_{ID2}$) are selected whereby secondary shoulder (SS) stress and primary shoulder (PS) stress at surface make-up are within 70% of each other depending on manufacturing tolerances of said lengths, areas and diameters.

17. The connection of claim 2, wherein said thread taper ($T_{TH}$) is about 1.125 inch per foot said external and internal threads are characterized by a thread depth (h), measured between a major radius $$\left(\frac{d_{MJ}}{2}\right)$$

and a minor radius $$\left(\frac{d_{MI}}{2}\right),$$

that is about one-half of the height (H) of a fundamental triangle of the threads, said internal threads (20) and said external threads (18) are characterized by a stab flank angle ($\Theta_S$) between about 35 and about 42 degrees and a load flank angle ($\Theta_P$) between about 25 and about 34 degrees.

18. The connection of claim 2, wherein said thread taper ($T_{th}$) is about 1.125 inch per foot, said stab flank angle ($\Theta_S$) is about 40 degrees and said load flank angle is about 30 degrees, roots of said internal threads (20) and said external threads (18) are formed in a shape of a portion of an ellipse (E), said internal threads (20) and said external threads (18) have a threaded taper ($T_{th}$), and said internal threads (20) and said external threads (18) are characterized by crests having a crest taper ($T_C$) which slopes in an opposite direction than that of said thread taper ($T_{TH}$).

19. The connection of claim 18, wherein said internal threads (20) and said external threads (18) are characterized by a thread form with a pitch of about 0.25 inch or greater, said length ($L_{PN}$) of said pin nose section (22) is about 1.25 inches and said length ($L_{BC}$) of said counterbore section (14) is about 1 inch, and said pin nose cross section area, said counterbore cross-section area and a length $L_{TH}$ of said internal threads (20) connected with said external threads (18) are designed and arranged such that strength of the connected threads with torque applied is greater than the strength of said pin nose (22) or said box counterbore (14) or said pin base.

20. The connection of claim 19, wherein when said pin (10) and said box (12) are connected together, said box external shoulder (28) and said pin external shoulder (30) define a Primary Shoulder (PS) and said pin face (26) and said box internal shoulder (24) define a Secondary Shoulder (SS), and said pin nose length ($L_{PN}$), said counterbore length ($L_{BC}$), a length ($L_{TH}$) of said internal threads (20) connected with said external threads (18), pin nose cross-sectional area ($CS_{PN}$), box counterbore area ($CS_{BC}$) and tool joint outer and inner diameters ($TJ_{OD}$, $TJ_{ID2}$) are selected whereby secondary shoulder (SS) longitudinal stress and primary shoulder (PS) longitudinal stress at surface make-up torque are within 70% of each other, depending on manufacturing tolerances of said lengths, areas and diameters.

21. A double shoulder connection (4) for use in a drill stem, having a pin (10) with external threads (18) formed between a pin external shoulder (30) and a pin face (26), a box (12) with internal threads (20) formed between a box face (28) and a box internal shoulder (24), the box (12) having a counterbore section (14) between the internal threads (20) and the box external shoulder (28), the pin having a base section (16) between the external shoulder (30) and the external threads (18), and a nose section (22) between the external pin face (26) and the external threads (18), said internal threads (20) and said external threads (18) are arranged and designed for connection with each other so that said box (12) and said pin (10) are connected with a primary seal (PS) formed by said pin external shoulder (30) forced against said box face (28) and a secondary shoulder (SS) formed by said pin face (26) forced against said box internal shoulder (24), and wherein said connection is characterized by said internal threads (20) and said external threads (18) have a stab flank angle ($\Theta_S$) between about 35 and about 42 degrees and a load flank angle ($\Theta_P$) between about 25 and about 34 degrees.

22. The connection of claim 21, wherein said external and internal threads having a thread depth (h), measured between a major radius $$\left(\frac{D_{MJ}}{2}\right)$$

and a minor radius $$\left(\frac{d_{MJ}}{2}\right),$$

that is about one-half of the height (H) of a fundamental triangle of the threads.

23. The connection of claim 21, wherein said stab flank ($\Theta_S$) angle is about 40 degrees and said load flank angle ($\Theta_P$) is about 30 degrees.

24. The connection of claim 21, wherein roots of said internal threads (20) and said external threads (18) are formed in a shape of a portion of an ellipse (E).

25. The connection of claim 21, wherein said internal threads (20) and said external threads (18) are characterized by crests having a crest taper ($T_C$) which slopes in an opposite direction than that of said thread taper ($T_{th}$).

26. The connection of claim 21, wherein said internal threads (20) and said external threads (18) are characterized by crests, and a transition shape (44) between said load flank (36) and said crest (42) includes a radius of curvature equal to or less than 0.012 inch, thereby providing a large load flank.

27. The connection of claim 21, wherein said internal threads (20) and said external threads (18) are characterized by thread crest widths formed by the truncation of the threads of a total height (H), and a transition shape (46) between said stab flank (34) of said crest (42) includes a radius of curvature greater than 80% of the said thread crest width, thereby enabling a gradual entry of the mating thread during stab-in and make up.

28. The connection of claim 21, wherein roots of said internal threads (20) and said external threads (18) are characterized by an elliptical shape that produces a stress concentration less than that of a 0.038 inch root.

29. The connection of claim 22, wherein said internal threads (20) and said external threads (18) have a taper ($T_{th}$) of about 1.125 inch per foot.

30. A double shoulder connection (4) for use in a drill stem, having a pin (10) with external threads (18) formed between a pin external shoulder (30) and a pin face (26), a box (12) with internal threads (20) formed between a box external shoulder (28) and a box internal shoulder (24), the box (12) having a counterbore section (14) between the internal threads (20) and the box external shoulder (28), the pin having a base section (16) between the external shoulder (30) and the external threads (18), and a nose section (22) between the external pin face (26) and the external threads (18), said internal threads (20) and said external threads (18) are arranged and designed for connection with each other so that said box (12) and said pin (10) are connected with a primary seal (PS) formed by said pin external shoulder (30) forced against said box external shoulder (28) and a secondary shoulder (SS) formed by said pin face (26) forced against said box internal shoulder (24), and wherein said connection is characterized by said internal threads (20) and said external threads having crests (42), and said internal threads (20) and said external threads have a crest taper ($T_C$) which slopes in a different direction from the center line of the drill pipe joint than a direction of slope from the centerline of said thread taper ($T_{th}$).

31. The connection of claim 30, wherein said internal threads (20) and said external threads are characterized by a stab flank angle of ($\Theta_S$) between about 35 and 42 degrees and a load flank angle ($\Theta_P$) between about 25 and 33 degrees.

32. The connection of claim 31, wherein said stab flank angle ($\Theta_S$) is about 40 degrees and said load flank angle ($\Theta_P$) is about 30 degrees.

33. The connection of claim 32, wherein said internal threads (20) and said external threads (18) are characterized by thread crest widths formed by the truncation of the threads of a total height (H), and a transition shape (46) between said stab flank (34) of said crest (42) includes a radius of curvature greater than 80% of the said thread crest width, thereby enabling a gradual entry of the mating thread during stab-in and make up.

34. A drill string comprising, a first drill pipe (2) with a threaded box tool joint (12) welded (6) to an upset portion (3) thereof and a second drill pipe (2') with a threaded pin tool joint (10) welded to an upset portion (3') thereof, with said threaded pin tool joint (10) screwed into connection with said box tool joint (12) wherein said first and second (2, 2') drill pipes are characterized by a pipe outer diameter ($P_{OD}$) and a pipe inner diameter ($P_{ID}$), and by a pipe upset inner diameter ($PU_{ID}$), said pin tool joint (10) and said box tool joint (12) are characterized by a tool joint outer diameter ($TJ_{OD}$), by a first tool joint inner diameter ($TJ_{ID1}$) at each weld end thereof and by a tool joint inner diameter ($TJ_{ID2}$) in a region adjacent box threads and pin threads wherein said tool joint outer diameter $TJ_{OD}$ is larger than said pipe outer diameter $P_{OD}$, said pipe upset inner diameter ($PU_{ID}$) in smaller than said pipe inner diameter ($P_{ID}$), said pipe upset inner diameter ($PU_{ID}$) is larger than said tool joint inner diameter ($TJ_{ID2}$), and said first tool joint inner diameter ($TJ_{ID1}$) is substantially equal to said pipe upset inner diameter ($PU_{ID}$) and said tool joint inner diameter ($TJ_{ID2}$) is smaller than said first tool joint inner diameter ($TJ_{ID1}$), wherein a wall thickness of said tool joint adjacent said pin and threads is enhanced for providing increased torque strength of the connection, and a length of tool joint characterized by $TJ_{ID2}$ is not greater than about ⅔ of the total tool joint length ($L_{TJ}$).

35. A double shoulder connection (4) for use in a drill stem, having a pin (10) with external threads (18) formed between a pin external shoulder (30) and a pin face (26), a box (12) with internal threads (20) formed between a box external shoulder (28) and a box internal shoulder (24), the box (12) having a counterbore section (14) between the internal threads (20) and the box external shoulder (28), the pin having a base section (16) between the external shoulder (30) and the external threads (18), and a nose section (22) between the external pin face (26) and the external threads (18), said internal threads (20) and said external threads (18) are arranged and designed for connection with each other so that said box (12) and said pin (10) are connected with a primary seal (PS) formed by said pin external shoulder (30) forced against said box external shoulder (28) and a secondary shoulder (SS) formed by said pin face (26) forced against said box internal shoulder (24), and wherein said drill pipe joint is characterized by a pin nose cross section area, $CS_{PN}$ which is at least 50% as large as the smaller of the area of the cross section of box counterbore $CS_{BC}$ or the cross-section of the pin base $CS_{PB}$, and the pin nose length $L_{PN}$ is from about 1 to 1.5 times the counterbore length $L_{BC}$.

36. The connection (4) of claim 35 wherein said counterbore section is characterized by a length $L_{BC}$ of about 1".

37. The connection (4) of claim 36 wherein thread characteristics of pitch, thread major diameter, and pitch diameter are arranged and designed so that less than 8 turns are required from stabbed to snugged.

* * * * *